United States Patent [19]

Ricci

[11] Patent Number: 4,565,144

[45] Date of Patent: Jan. 21, 1986

[54] TOWEL SUPPORT

[76] Inventor: John D. Ricci, 6942 Well Springs Rd., No. 9-H, Midvale, Utah 84047

[21] Appl. No.: 557,054

[22] Filed: Dec. 1, 1983

[51] Int. Cl.[4] ..... A41F 1/02

[52] U.S. Cl. ..... 112/437; 112/264.1; 15/222; 2/271

[58] Field of Search ..... 112/437, 264.1; 2/266, 2/271, 128; 15/227, 209 R, 222; 139/396

[56] References Cited

U.S. PATENT DOCUMENTS

| | | | |
|---|---|---|---|
| 1,488,332 | 3/1924 | Foerg | 15/227 X |
| 1,990,568 | 2/1935 | Scheidler | 15/222 |
| 2,035,014 | 3/1936 | Schaefer | 15/222 X |
| 2,352,067 | 6/1944 | Barr | 139/396 |
| 2,713,686 | 7/1955 | Oster et al. | 2/266 |
| 2,830,313 | 4/1958 | Mountanos | 15/222 X |
| 3,536,554 | 10/1970 | Weiss | 2/266 X |

*Primary Examiner*—Werner H. Schroeder
*Assistant Examiner*—J. L. Kravitz
*Attorney, Agent, or Firm*—Mallinckrodt, Mallinckrodt, Russell & Osburn

[57] ABSTRACT

A towel support for a standard, preferably large, bath-type towel, consisting of at least one slot formed through that towel at a minimum distance from a towel corner and cut on the bias to the towel weave.

4 Claims, 3 Drawing Figures

TOWEL SUPPORT

BACKGROUND OF THE INVENTION

1. Field

This invention relates to towel or like cloth items and particularly to a hanger arrangement for hanging same.

2. Prior Art

Over the years, numerous arrangements and devices have been employed for supporting a towel. Some such arrangements have included one or more loops joined to a towel edge for fitting over an appropriate hook, and, of course, numerous kinds and types of rack arrangements have been employed for supporting a towel draped thereover. And where holes or openings have been formed in a towel to fit a hook through, such holes have been such as to weaken the towel material such that, when hung over a long period of time or where a water-saturated towel has been supported therefrom, the weight of that towel has tended to rip out the material around that hole. This is particularly true with a large towel, as is preferred for use with the present invention. The present invention, by arranging an opening or slot on the bias across the towel weave and setting that slot back a minimum distance from the towel edges at a corner, provides a support point wherefrom a large towel, even one soaked with water, can be hung without incurring damage to the area of the towel surrounding the slot.

SUMMARY OF THE INVENTION

It is, therefore, the general object of the present invention to form through a large towel at least one opening or slot for hanging over a hook or nail to conveniently support the weight of that towel without damaging the towel areas surrounding that opening or slot.

In accordance with the above object, the present invention in a towel support includes forming at least one opening or slot through a large towel for hanging that towel from a hook or like hanger to support the towel without stretching or damaging the towel area around that opening or slot as when a wet towel is hung therefrom. The opening or slot is preferably formed as a cut through the towel on the bias to the towel weave, that is reinforced by appropriate stitching therearound, and is spaced apart a minimum distance from a towel corner. In practice, the upper end of that slot to the proximate towel corner is offset or set back at a right angle from the towel adjacent edges a minimum of two inches from each. The slot is cut on the bias to the towel weave at an angle between thirty to sixty degrees (30° to 60°), with that angle preferably a forty-five degree (45°) angle across that weave. The knots of the weave that are thereby cut are vertically offset to those of the rows below and above, leaving that weave essentially intact, so as to minimize a likelihood that the material will tear as it is stretched at the slot end. Preferably, slots are cut in opposite corners of the towel such that the towel can be hung from either corner.

BRIEF DESCRIPTION OF THE DRAWINGS

In the drawings is shown that which is presently regarded as the best mode for carrying out the invention.

DETAILED DESCRIPTION OF THE DRAWINGS

Figure 1:
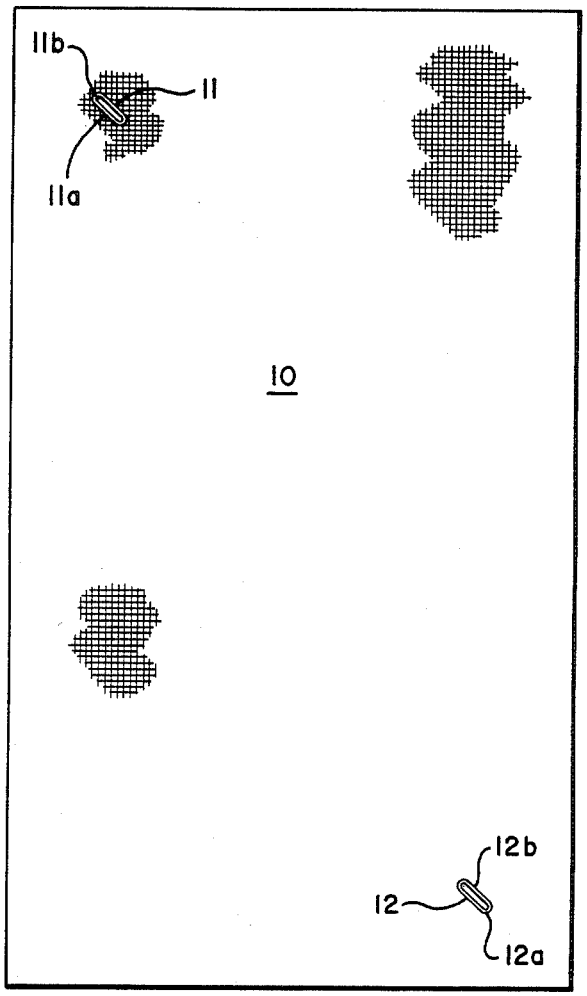
FIG. 1 shows a top plan view of a towel of the invention that is preferably a large towel, wherein slots are shown formed proximate to opposite towel corners.

FIG. 1 shows a towel 10 that is preferably a large bath-type towel that, when used to dry a person, is capable of absorbing a large quantity of liquid. The towel, of course, could also be used for other purposes, such as for display, decoration, or the like. After use for drying a person, it is desirable to hang that towel so as to allow it to air-dry.

Figure 2:
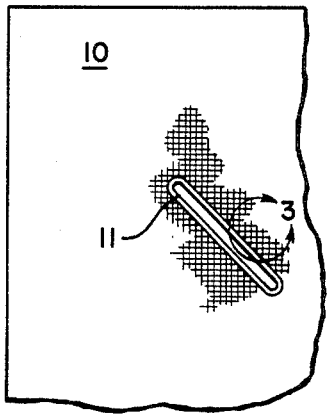
FIG. 2 shows an enlarged view of a section of the towel taken at a slot.

The present invention involves forming in that towel an arrangement for hanging the towel from a hook, or the like. Preferably, the arrangement consists of forming at least one slot or opening 11 through the towel near a corner thereof. Shown in FIG. 1, two slots 11 and 12 are formed in opposite towel corners. Each is cut on the bias to the towel weave at approximately a forty-five degree (45°) angle thereto, as shown in FIG. 2. Bias cutting of the slot through the towel that provides a minimum interruption of the structural integrity of the towel weave, the cut traveling between adjacent rather than aligned weave knots, and is preferably reinforced by stitching therearound shown at 11*a* and 12*a* which stitching will be understood to be like that used to reinforce a conventional button hole. The weave will therefore tend to retain both its shape and strength, when a stretching force is applied thereagainst as when the towel is hung through that slot from a hook, rod or the like, not shown.

Figure 3:
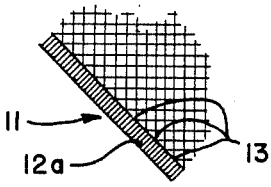
FIG. 3 shows a sectional view taken within the line 3—3 of FIG. 2, showing the slot cut on the bias to the towel weave.

FIG. 3 shows a section of the slot 11 with the knots of the weave wherethrough the opening is formed shown as right angle intersections and identified as knots 13. These knots represent a standard towel weave. It has been found in practice that by cutting across each such knot and then reinforcing the area around that slot by appropriately stitching the slot sides therearound, as shown at 12*a*, the weave will tend to maintain its integrity better than if a cut were made along the weave, essentially parallel to the top towel edge, or across the weave, essentially perpendicular to the top towel edge. The preset invention, therefore, resides in cutting a slot in the towel bias to that weave, which cut is shown herein as being approximately forty-five degrees (45°).

Additional to the angle of slots 11 and 12, to provide a minimum interruption to the towel integrity, it is preferred to form each slot relative to a towel corner such that it is set back at a slot upper end 11*b* or 12*b*, as measured from the towel sides that make up the proximate corner, a minimum of two (2) inches perpendicular from that slot end to each towel side. So arranged, sufficient towel material will remain between the towel edge and the slot end such that the towel weave integrity will be maintained, minimizing stretching around that slot, even when a fully saturated towel is hung from a hook, not shown.

FIG. 1 shows the invention as preferably including the pair of openings or slots 11 and 12, arranged in opposite corners, with each perferably reinforced by stitching therearound, and each offset at least the minimum distance from the towel edge to the opening or slot ends 11*b* and 12*b*, respectively. By providing the two openings 11 and 12, the towel can be hung from either end, and particularly during a first phase of an air-drying process it can be hung from one end and then turned over to dry from the opposite end, maintaining a maximum wet area throughout the towel to speed up the drying process.

While the preferred arrangement of openings or slots cut on the bias to the towel weave and reinforced in a standard large towel have been shown herein as preferred, it should be understood that the invention does not reside in the single angle of slot only and that a range of cut angles can be incorporated within the scope of this disclosure. In practice, it has been found that an opening or slot cut on the bias across the towel weave, at an angle of from thirty degress to sixty degrees (30° to 60°) will provide the desired slot integrity described hereinabove. The invention should, therefore, be understood to reside in forming at least one opening or slot, as described, in and through a large towel, within that range of angles and set back from the towel sides proximate to a towel corner a minimum of two inches.

A preferred arrangement of the towel of the present invention has been shown as described herein. It should, however, be understood that the present disclosure is made by way of example only, and that other arrangements of a single or plurality of slots are possible without departing from the subject matter coming within the scope of the following claims, which claims I regard as my invention.

I claim:

1. A towel support for maintaining a towel from a hanger device comprising, a slot cut on a bias to the towel weave through vertically adjacent knots of said towel weave at an angle in a range of angles of from thirty to sixty degrees (30° to 60°) to the vertical of said towel weave, an end of said slot closest to a towel corner is spaced apart from the towel sides proximate to said corner a minimum of two (2) inches from and at right angles to each said side.

2. A towel support as recited in claim 1, wherein the towel support slot is reinforced by stitching the slot sides therearound.

3. A towel support as recited in claim 1, wherein towel support slots are formed in opposite towel corners.

4. A towel support as recited in claim 1, wherein the slot is cut through the towel at a forty-five degree (45°) angle to the vertical of the towel weave.

* * * * *